US005541392A

United States Patent [19]

Miklos

[11] Patent Number: 5,541,392

[45] Date of Patent: Jul. 30, 1996

[54] PRODUCT TRAY FOR DIELECTRIC OVEN

[75] Inventor: Joseph P. Miklos, Germantown, Ohio

[73] Assignee: Henny Penny Corporation, Eaton, Ohio

[21] Appl. No.: 239,522

[22] Filed: May 9, 1994

[51] Int. Cl.[6] ..... H05B 6/54

[52] U.S. Cl. ..... 219/771; 219/780; 99/358; 99/DIG. 14

[58] Field of Search ..... 219/771, 780; 99/358, 451, DIG. 14

[56] References Cited

U.S. PATENT DOCUMENTS

| | | | |
|---|---|---|---|
| 2,474,420 | 6/1949 | Himmel . | |
| 2,512,311 | 6/1950 | Davis . | |
| 2,542,589 | 2/1951 | Stanton et al. . | |
| 3,082,710 | 3/1963 | Holland . | |
| 3,591,751 | 7/1971 | Goltsos . | |
| 3,866,255 | 2/1975 | Serota . | |
| 3,877,360 | 4/1975 | Vigerström | 99/358 |
| 4,010,341 | 3/1977 | Ishammar . | |
| 4,296,298 | 10/1981 | MacMaster et al. . | |
| 4,303,820 | 12/1981 | Stottmann et al. . | |
| 4,320,276 | 3/1982 | Takeuchi et al. | 219/771 |
| 4,522,834 | 6/1985 | Miyahara . | |
| 4,812,609 | 3/1989 | Butot . | |
| 4,910,371 | 3/1990 | Brun et al. | 219/771 |
| 4,971,819 | 11/1990 | Miyahara | 219/771 |
| 4,978,826 | 12/1990 | DeRuiter et al. . | |
| 4,980,530 | 12/1990 | Butot . | |
| 5,055,312 | 10/1991 | Hildebrand | 219/771 |
| 5,279,213 | 1/1994 | Miyahara | 99/358 |

FOREIGN PATENT DOCUMENTS

WO8912947 12/1989 WIPO .

*Primary Examiner*—Philip H. Leung
*Attorney, Agent, or Firm*—Baker & Botts, L.L.P.

[57] ABSTRACT

A removable tray holds a product for heating in a dielectric oven. The tray comprises at least one wall defining an interior, wherein the at least one wall is made from a non-electrically conductive material, such as a polycarbonate resin having a thickness in a range of about 0.08 to 0.09 inches (about 2.03 to 2.29 mm). The at least one wall includes at least a first and a second electrode. Each of the electrodes comprises a first portion and a second portion, wherein the first portion is separated from the tray interior by a thickness of polycarbonate resin in a range of about 0.01 to 0.03 inches (about 0.25 to 0.76 mm). The first portions bracket the product, are substantially parallel to each other, and are encased within the at least one wall. Each of the second portions has an exposed area which when the tray is placed in the oven is coupled with an electromagnetic energy source to produce an electromagnetic field between the electrodes.

12 Claims, 6 Drawing Sheets

PRODUCT TRAY FOR DIELECTRIC OVEN

BACKGROUND OF THE INVENTION

1. Field of the Invention

This invention relates to a tray for holding a product during heating in a dielectric oven, such as for cooking foodstuffs. Particularly, it relates to a tray for holding the product in such an oven, so that electrodes for producing an electromagnetic field are more easily maintained and inspected and energy is quickly and efficiently transferred to the product. Further, it relates to such trays for use in dielectric ovens having multiple support levels therein for heating commercial quantities of the product.

2. Description of the Related Art

Commercial ovens are commonly convection ovens utilizing a slow convection heating process. Dielectric ovens, however, heat a product due to the electric, i.e., dielectric, losses caused when the product is placed in a varying electromagnetic field. If the product is homogeneous and the electromagnetic field is uniform, heat may develop uniformly and simultaneously throughout the mass of the product.

Ovens utilizing dielectric high frequency heating are known, and examples of such ovens are disclosed in U.S. Pat. Nos. 4,812,609 to Butot; 4,978,826 to DeRuiter et al.; and 4,980,530 to Butot, which are incorporated herein by reference. Such ovens may operate in a frequency range of 2 to 40 MHz. Referring to FIG. 1*a*, a dielectric oven 200 may be fitted with guide racks 202 for stacking a plurality of trays 204 carrying a product 206 to be heated. These racks 202 also may function as electrodes for producing the electromagnetic field.

Dielectric ovens may utilize an oscillating circuit or circuits requiring specially designed electromagnetic energy sources, e.g., power tubes. Such electromagnetic energy sources may be coupled and supply current to guide racks/electrodes 202 via contacts 205 which project into a heating cavity 208 through an oven housing 209. Such oscillating circuits generally provide a substantially fixed distribution of voltage and power within a heating cavity. Thus, longer heating times may be required for heating larger volumes of products. Further, frequencies at which the ovens may vary dependent upon the characteristics of the product being heated.

Referring to FIG. 1*b*, although dielectric ovens 200' may handle a plurality of vertically stacked trays 204', which permit products to be heated at multiple levels 210' within a single heating cavity 208', only a single pair of electrodes 202' may be provided to transfer the electromagnetic energy for heating. Thus, when a number of different heating levels 210' are used, the quantity of energy delivered to the product 206' in each tray may be reduced, and longer heating times may be required. As discussed above, electromagnetic energy sources may be coupled and supply current to electrodes 202' via contacts 205' which project into a heating cavity 208' through an oven housing 209'.

A dielectric oven may include a heating cavity defined by an oven housing for receiving a tray containing the product, a high frequency oscillating circuit having an electromagnetic energy source, e.g., a power tube, for generating a high frequency electric signal, and electrodes which may be coupled to the energy source and configured to produce an electromagnetic field in the cavity to transfer power from the oscillating circuit to the product. Such ovens may be operated to increase the power transferred from the oscillating circuit to the product, without increasing the operating voltage of the power source or the frequency of its operation. Moreover, such ovens may include a plurality of oscillating circuits having substantially similar resonant frequencies.

As noted above, the oscillating circuits may receive power from a power tube in order to establish respective oscillating signals. More particularly, at least first and second oscillating circuits may be provided, and the electrode configuration may include pairs of at least first and second electrodes which are respectively connected to the two oscillating circuits. The tray containing the product may be bracketed between electrodes of a capacitor in the oscillating circuit. The oscillating circuit may be arranged to provide a voltage across the capacitor which is twice the voltage across the power tube, thereby, permitting the doubling of distance between the electrodes of the capacitor without reducing the electromagnetic field strength. Thus, the quantities of the product which may be heated between the capacitor electrodes may be increased.

Each of the oscillating circuits may also include an inductance and a capacitance. The capacitance includes a pair of capacitors respectively formed between two electrodes of the oscillating circuit and a pair of capacitor plates or, for example, wall portions of the oven housing. Preferably, the two electrodes of each oscillating circuit are oriented to radiate an open electromagnetic field therebetween. In this configuration, a pair of interconnecting load capacitors is formed between the electrodes and capacitor plates of the oscillating circuits. The dielectric of the load capacitors includes the product placed between the electrodes. This configuration produces an open electromagnetic field between the electrodes of each of the pair of interconnecting (load) capacitors. The open electromagnetic field has a power intensity distribution determined by the dielectric characteristic of the product, while permitting the energy source to operate at a substantially constant power level. Further, the use of the load capacitors isolates the frequency of oscillation of the oscillating circuits from the effects of the dielectric characteristics of the product.

Electrodes affixed within a dielectric oven may be difficult to clean, maintain, inspect, and repair, and the oven may not be operated while electrodes are being removed for servicing or replacement. Further, if the electrodes function as racks, the electrodes are more susceptible to fouling, denting, and other damage. Fouling may be caused by the deposit of tray material on the electrodes as trays are slid onto and off of the electrodes. Fouling also may result from product residue or films of cleaning chemicals which may adhere to the tray and be deposited on the electrodes.

Uneven tray surfaces and improper or careless tray placement may cause dents and scoring of the electrodes. Such damage may adversely effect the uniformity of the electromagnetic field produced between the electrodes. Moreover, dents and scoring of the electrodes may increase the likelihood and severity of fouling because the dents and scoring may scrape residue or tray material from the tray sides and make cleaning the electrodes more difficult. Damage to the electrodes caused by denting and scoring may be exacerbated by subsequent fouling because the fouling deposits are within the electromagnetic field produced in the oven. Further, fouling also may result in localized pitting or general corrosion of the electrodes.

If the electrodes are separated from the tray, as depicted in FIG. 1*b*, and not used as tray racks, the oven may be made larger or the tray smaller. A larger oven would require greater energy to produce the same electromagnetic field strength. Smaller trays, however, would reduce the quantity of product heated and make the dielectric oven less economical.

SUMMARY OF THE INVENTION

Thus, a need has arisen for a removable tray for holding products for heating in a dielectric oven, so that the products may be quickly and efficiently heated in economical quantities. Additionally, it is an object of this invention to provide a tray which places the electrodes in the closest proximity to the products. It is an advantage of this invention that the tray design reduces the fouling of the electrodes. It is a feature of the invention that the electrodes may be encased within the wall(s) of the tray. In yet another embodiment, the electrodes may be removable and also may be coated with a non-electrically conductive, non-stick coating, such as polytetrafluoroethylene (PTFE), to permit easy cleaning of the electrodes.

Another object of the invention is to produce an open electromagnetic field between the electrodes of the pair of oscillating circuits, while connecting electrodes to an electromagnetic energy source. It is an advantage of this invention that while producing an open electromagnetic field containing the product, the power loss caused by the passage of the electromagnetic field through the tray may be substantially eliminated.

It is yet another object of the invention that a variable air gap may be used for controlling the power applied to the product within the heating cavity. This may be accomplished by varying the size of the air gap by moving a capacitor plate outside of the heating cavity. The air gap may be formed between capacitor plates which are outside of the heating cavity or which consist of the portions of oven housing and the electrodes encased within or mounted on the trays. Such an air gap may be used for controlling the energy delivered to the product.

Still another object of the invention is the provision of a multi-level heating structure in the dielectric oven, including separate pairs of electrodes to produce separate electromagnetic fields for each of a plurality of vertically stacked trays within the heating cavity of the oven. It is an advantage of this invention that the electrodes may be removed with the trays and, thus, are less susceptible to damage. It is a feature of this design that such electrodes may also be more easily maintained and inspected.

The invention includes a removable tray for holding products for heating in a dielectric oven. The tray comprises at least one wall defining an interior cavity, e.g., a wall with a circular, oval, or rectangular horizontal cross-sectional shape. The wall is made from a non-electrically conductive material. This material may have a low loss tangent, e.g., a loss tangent less than about 0.015, and a melting point greater than the boiling point of a heating fluid, such as water, e.g., at least about 225° F. (107° C.). The at least one tray wall includes at least a first and a second electrode. Each of the electrodes includes a first portion and a second portion, such that the first portions bracket the product, are substantially parallel to each other, and are encased within the at least one wall. Each of the second portions has an exposed area which when the tray is placed in the oven is coupled to an electromagnetic energy source to produce an electromagnetic field between the electrodes.

Another embodiment of the invention includes a removable tray for holding a product for heating in a dielectric oven. The tray comprises at least one wall defining an interior. The at least one wall is made from a non-electrically conductive material. At least a first and a second electrode are mounted on the tray, prior to placing the tray in the heating cavity. Each of the electrodes includes a first portion and a second portion. When the at least first and second electrodes are mounted on the tray, the first portions extend into the tray, bracket the product, and are substantially parallel to each other. Each of the second portions conforms to an upper peripheral edge of the tray, e.g., the tray lip, and each of the second portions has an exposed area which when the tray is placed in the oven is coupled with an electromagnetic energy source to produce an electromagnetic field between the electrodes.

In yet another embodiment, the invention includes a dielectric oven for heating a product within a tray. The oven has a housing having at least one housing side wall defining a heating cavity and at least a pair of contacts projecting into the cavity through the at least one housing side wall. An electromagnetic energy source, such as a source of alternating current, is coupled and supplies current to each of the contacts. The current may have a frequency in a range of about 10 to 30 MHz, e.g. about 27.2 MHz. The oven further includes a removable tray, such as those described above. Such trays include at least a first and a second electrode which are encased within or mounted on the wall(s) of the tray.

Other objects, advantages, and features will be apparent when the detailed description of the invention and the drawings are considered.

DETAILED DESCRIPTION OF THE INVENTION AND PREFERRED EMBODIMENTS

Figure 1A:
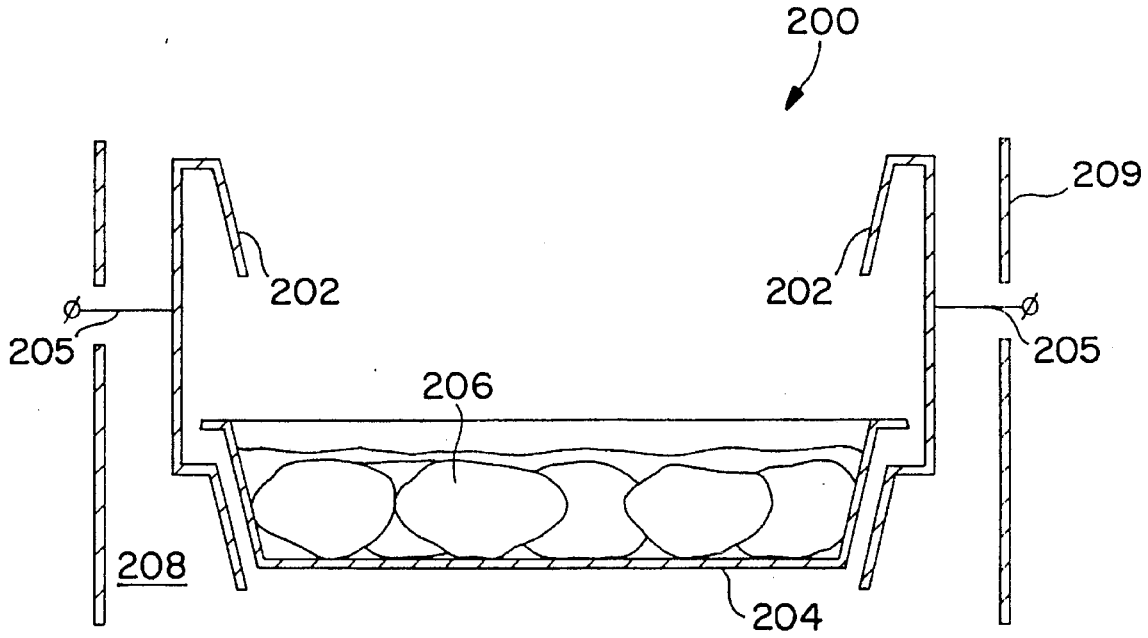
FIG. 1a PRIOR ART
FIG. 1*a* depicts a known dielectric oven in which trays are supported by a guide rack/electrode configuration.
Figure 1B:
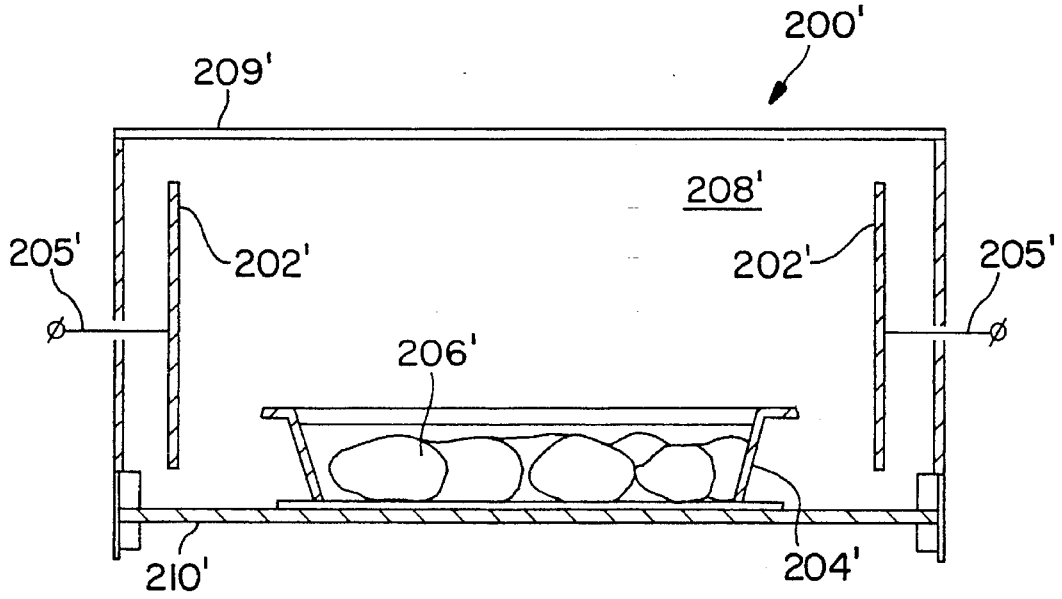
FIG. 1b PRIOR ART
FIG. 1*b* depicts a known dielectric oven in which trays are positioned between two electrodes.
Figure 2:
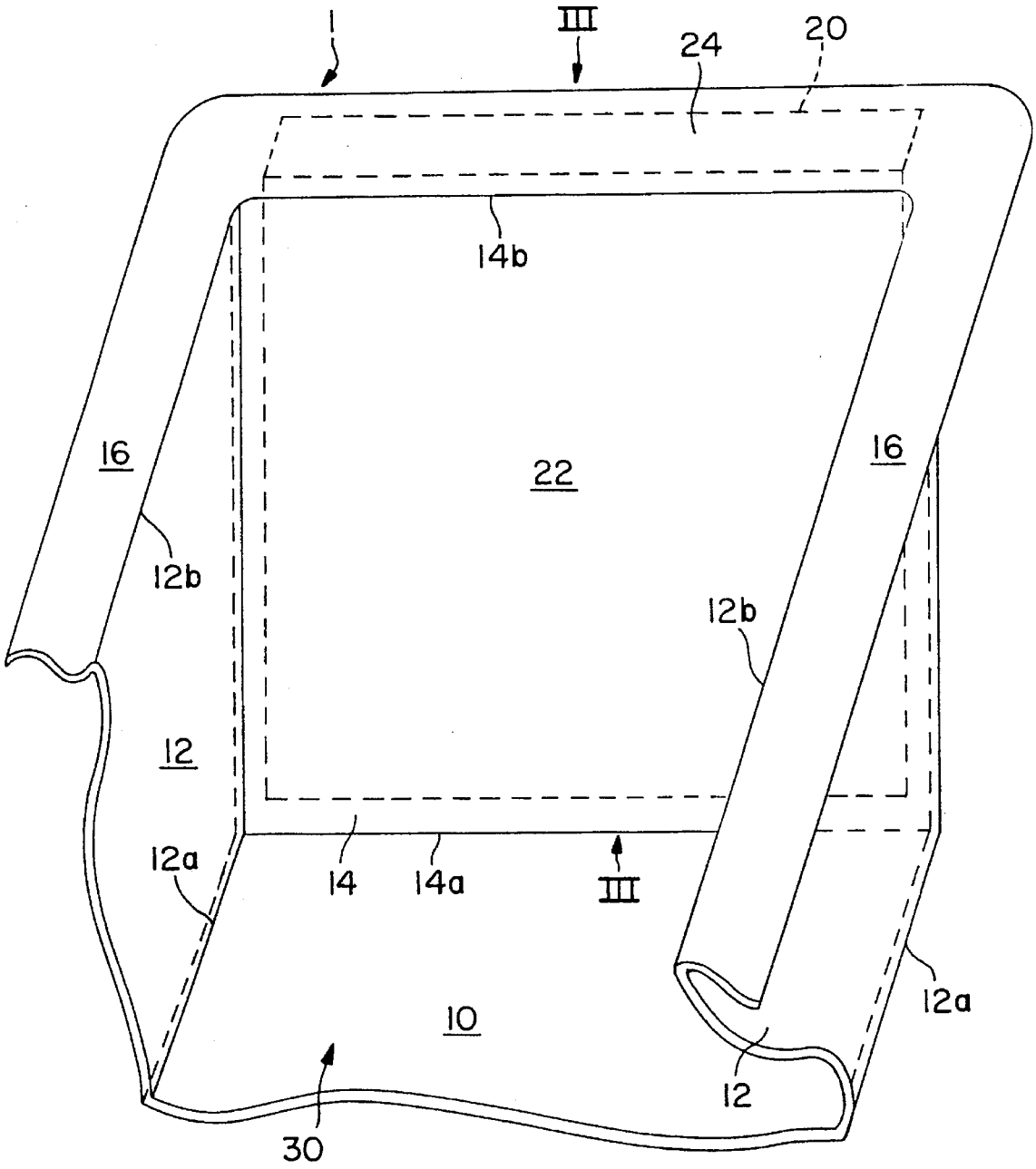
FIG. 2 depicts a cut-away, perspective view of a tray including an electrode encased in an end wall.

Referring to FIG. 2, a tray 1 is depicted which has a bottom wall 10, side walls 12, and end walls 14, only one of which is shown. In tray 1, side walls 12 are substantially parallel to each other, and end walls 14 are substantially parallel to each other. Side walls 12 and end walls 14 have lower edges 12*a* and 14*a*, respectively, at which side walls 12 and end walls 14 are joined to bottom wall 10. The upper edges 12*b* and 14*b* of side walls 12 and end wall 14, respectively, form a tray lip 16. Side walls 12, end walls 14, and bottom wall 10 define a product cavity 30. Products, such as solid foodstuffs or soups or stews, may be placed in cavity 30. Alternatively, cavity 30 may be filled with a heating fluid, such as water, and products, such as potatoes or other vegetables, may be placed in the fluid. When a heating fluid is used, the products may be heated by a combination of the dielectric heating of the product and the dielectric heating of the heating fluid.

An electrode 20 is substantially encased within each of two substantially parallel side walls 12 or end walls 14. In FIG. 2, each electrode 20 is substantially encased in one of end walls 14 and includes a first portion 22 and a second portion 24. First portion 22 extends from about lower edge 14*a* to upper edge 14*b* of end wall 14, and the width of electrode 20 is about equal to the width of end wall 14. Second portion 24 is contained in tray lip 16 and is substantially perpendicular to first portion 22. Electrodes 20 are made of a non-magnetic, electrically conductive material, such as a metal, and may be made from a metal selected from a group consisting of copper, stainless steel, and aluminum. Although copper and aluminum may corrode when exposed to water and energized with an electric current, such corrosion is effectively controlled or eliminated because electrodes 20 are substantially encased within the walls of tray 1. Further, although electrodes 20 may be made from aluminum, the danger of contaminating products heated in tray 1 with aluminum or aluminum oxides is greatly reduced by enclosing electrodes 20 within tray walls 12 or 14.

Figure 3:
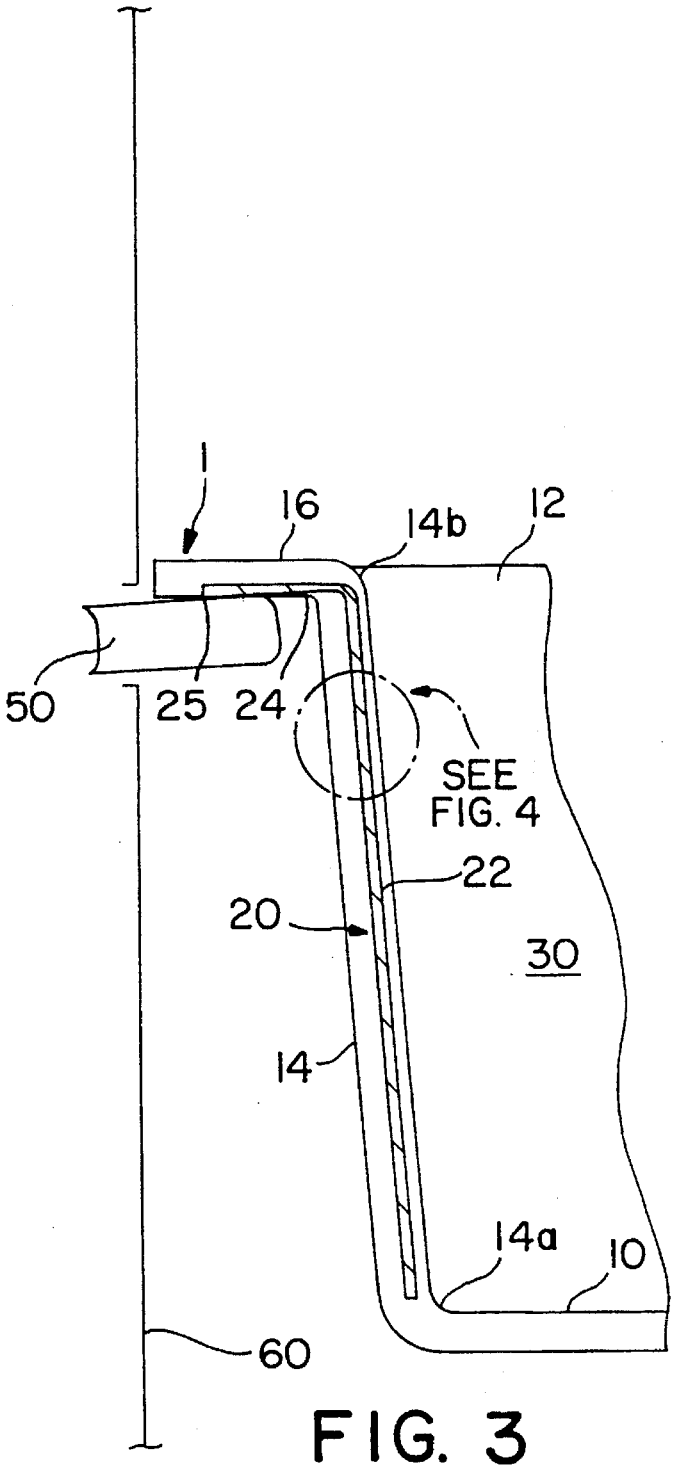
FIG. 3 depicts a cross-sectional view of an end wall of the tray depicted in FIG. 2 along line III—III.

Referring to FIG. 3, a cross-sectional view of tray 1, along line III—III, depicted in FIG. 2 is shown supported on a contact 50 which extends through an oven housing wall 60 into a heating cavity 70 of a dielectric oven. An electromagnetic power source 80, such as a power tube, is connected to contact 50. Although electrode 20 is substantially encased within end wall 14 of tray 1, an exposed area 25 of second portion 24 is not encased to permit coupling between electrode 20 and contact 50. Because electrodes 20 are encased in tray walls 14, tray walls 14 are preferably made from a non-electrically conductive material. Suitable materials include thermoplastic resin selected from the group consisting of polysulphone, polyester, and polycarbonate resins. Such tray materials may have a low dielectric loss tangent, e.g., a loss tangent less than about 0.015, and a melting point higher that the boiling point of the heating fluid, e.g., at least about 225° F. (107° C.) when the heating fluid is water.

Figure 4:
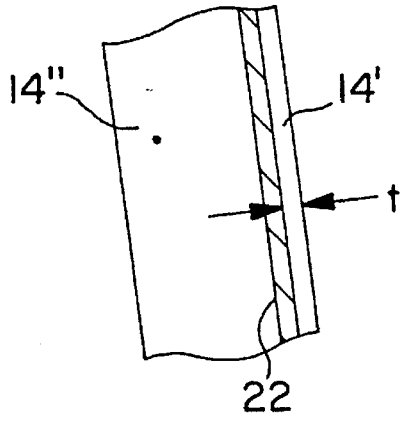
FIG. 4 is an enlarged view of a portion of the end wall of the tray depicted in FIG. 3.

FIG. 4 depicts an enlarged view of a portion of the cross-sectional view of FIG. 3. When tray walls 14 are made from a polycarbonate resin, walls 14 encasing electrodes 20 may have a thickness, including electrodes 20, in a range of about 0.08 to 0.09 inches (about 2.03 to 2.29 mm). Because the electromagnetic field produced when electrodes 20 are energized loses strength as it passes through enclosing walls 14 and generates heat within walls 14, the separation 14' between electrodes 20 and cavity 30, i.e., the interior of tray 1, is reduced. In tray 1 having polycarbonate resin walls, as discussed above, the thickness of separation 14' between first portion 22 and cavity 30 may be in a range of about 0.01 to 0.03 inches (about 0.25 to 0.76 mm).

Because water has a relatively high loss tangent, water used as a heating fluid within cavity 30 may boil when electrodes 20 are energized with sufficient electromagnetic energy. Thus, a product placed within cavity 30 may be heated due to a combination of the dielectric losses in the product and the boiling of the water. Because commonly used cooking oil has a low loss tangent, however, little or no dielectric losses may occur in the cooking oil when electrodes 20 are energized. For this reason, it may be necessary to provide an additional means of heating the cooking oil in order to fry foods. See U.S. Pat. No. 4,980,530, previous incorporated by reference. Although frequencies between 2 and 40 MHz are used in dielectric ovens, preferred frequencies may be in a range of about 10 to 30 MHz, e.g., about 27.2 MHz. Nevertheless, the most efficient frequency will depend on the product to be heated, the uniformity of the product, and the heating fluid selected, if any.

Figure 5:
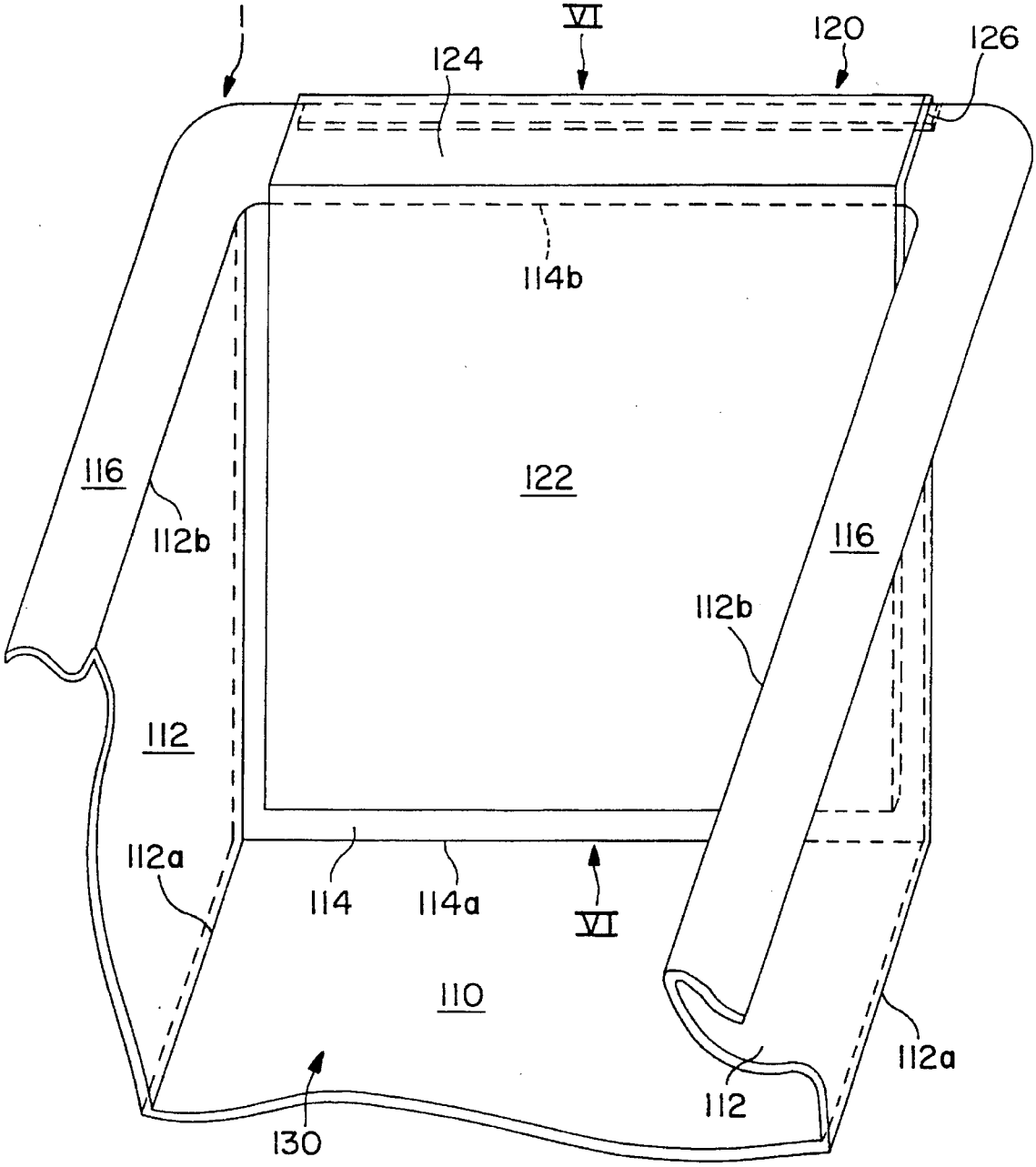
FIG. 5 depicts a cut-away, perspective view of a tray with an electrode mounted on an end wall.
Figure 6A:
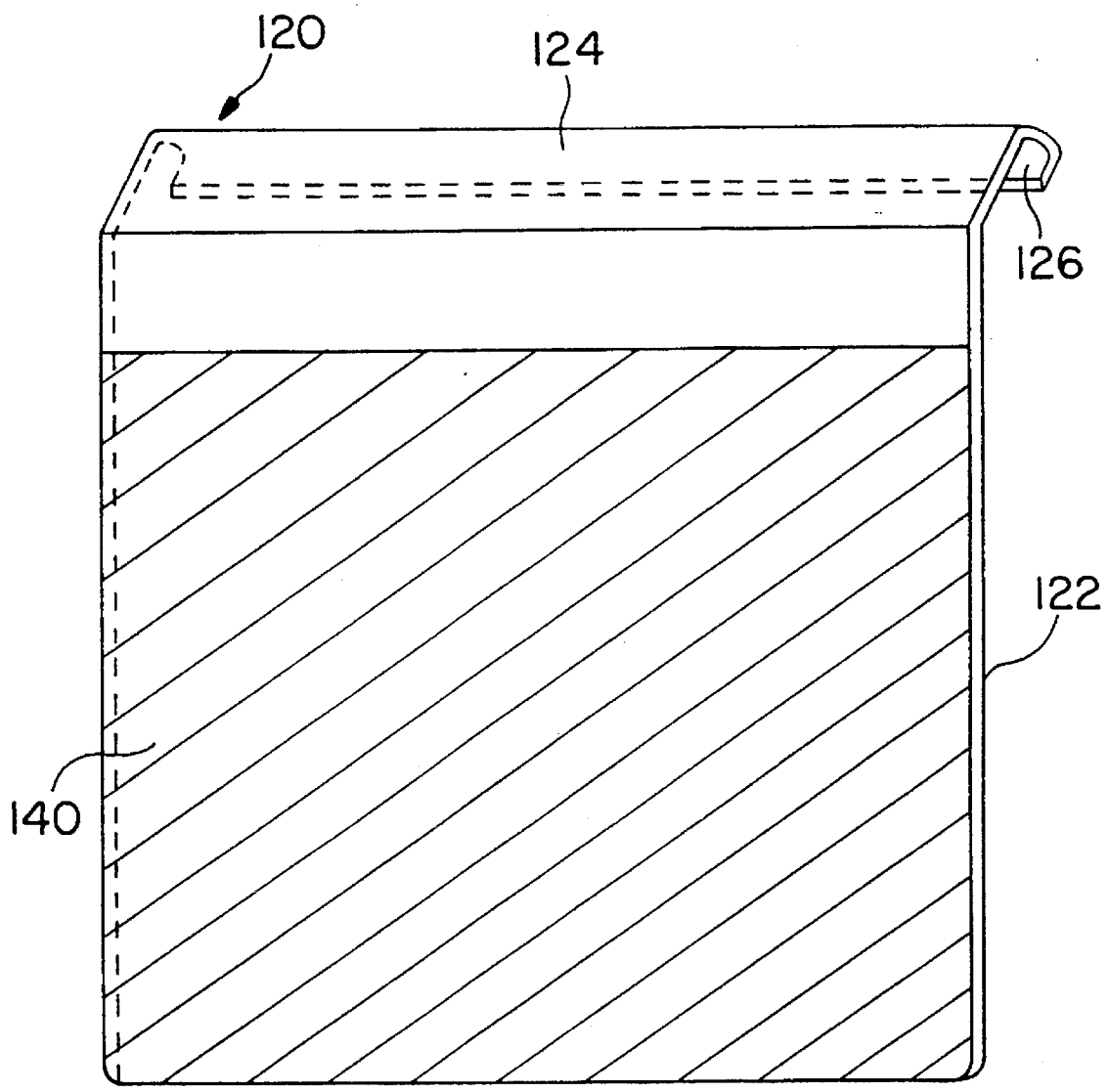
FIG. 6*a* is a perspective view of a removable electrode coated with a non-electrically conductive, non-stick material.
Figure 6B:
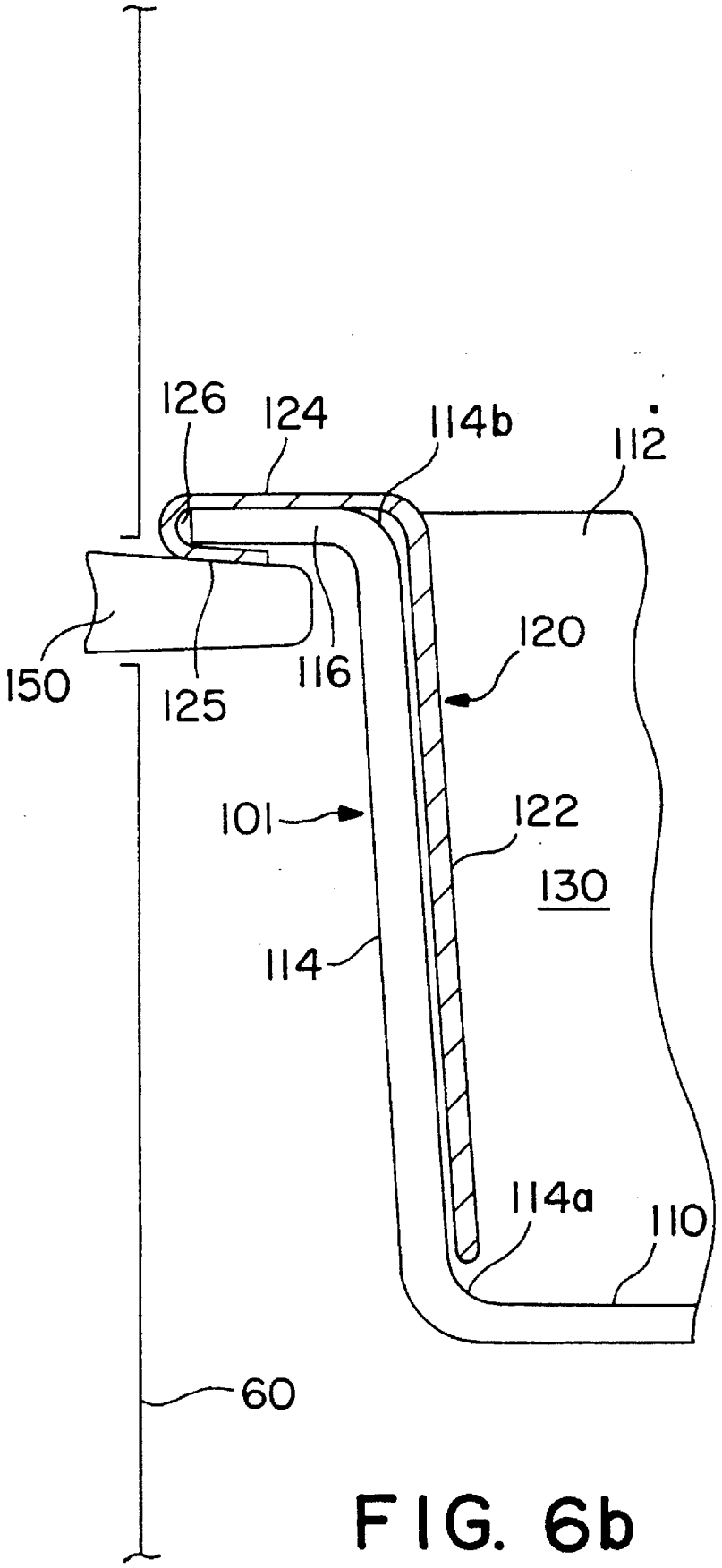
FIG. 6*b* is a cross-sectional view of an end wall of the tray depicted in FIG. 5 along line VI—VI.

Referring to FIGS. 5, 6*a*, and 6*b*, like or similar elements to those depicted in FIGS. 2 and 3 are denoted with the reference numerals thereof plus 100. In FIG. 5, an alternative embodiment of the invention is depicted in which a pair of electrodes 120 (only one shown) may be mounted on a tray 101. Tray 101 includes a bottom wall 110, side walls 112, and end walls 114, and electrodes 120 may be mounted on opposing side walls 112 or end walls 114. Although in this embodiment, electrodes 120 are not encased in tray walls 114, tray walls 114 are in close proximity to and may be inside the electromagnetic field produced between electrodes 120. Therefore, tray walls 114 are preferably made from a non-electrically conductive material. Suitable tray wall 114 materials include thermoplastic resins selected from the group consisting of polysulphone, polyester, and polycarbonate resins. Again, such materials may have a low loss tangent, e.g., a loss tangent less than about 0.015.

Like electrodes 20 depicted in FIG. 2, electrodes 120 bracket the product to be heated within a product cavity 130, i.e., the interior of tray 101. Nevertheless, because electrodes 120 are mounted on and not encased within either opposing side walls 112 or end walls 114, electrodes 120 may be easily inspected for damage or corrosion. Further, electrodes 120 may be removed from tray 101 for separate cleaning or maintenance. Electrodes 120 are made from a non-magnetic, electrically conductive material, such as a metal, and that metal may be selected from the group consisting of stainless steel and copper.

In the embodiment depicted in FIG. 6*a*, electrode 120 includes a first portion 122 and a second portion 124. When mounted on tray 101, first portion 122 extends into cavity 130 and may be in direct contact with the product or with a heating fluid, such as water or cooking oil, e.g., vegetable oil, and products, such as potatoes or other vegetables, may be placed in the fluid. When a fluid is used in this embodiment, the products may be heated by a combination of the dielectric heating of the product and the dielectric heating of the heating fluid.

As discussed above with respect to the embodiment depicted in FIG. 3, because water has a relatively high loss tangent, water placed within cavity 130 may boil when electrodes 120 are energized with sufficient electromagnetic energy. Therefore, products placed within cavity 130 may be heated due to the dielectric losses in the product and the boiling of the water. Again, however, because cooking oil has a low loss tangent, little or no dielectric loss may occur in the cooking oil when electrodes 120 are energized. As discussed above, it may be necessary to provide an additional means of heating the cooking oil in order to fry foods with the cooking oil. Moreover, the most effective frequency may vary with the product heated, the uniformity of the product, and the heating fluid selected, if any.

Because first portion 122 of electrode 120 is not shielded from the product by a layer of side wall 112 or end wall 114, the product may contact and foul the surface of electrode 120, i,e., residue from the heated product or portions of the product may deposit on electrodes 120. This could reduce the efficiency of the oven's operation and cause damage, e.g., corrosion or pitting, to electrode 120. Electrodes 120 also may be dented or scored by heavy products, such as potatoes, moving in a heating fluid, such as boiling water. Further, if electrodes 120 become fouled or damaged by contact with the product, product heating may be delayed or oven operation stopped while electrodes 120 are cleaned, repaired, or replaced.

As shown in FIG. 6*a*, electrodes 120 may be coated with a layer 140 of a non-electrically conductive, non-stick material. Such materials may also have a low dielectric loss tangent. Polytetrafluoroethylene (PTFE), available as Teflon® plastic from the DuPont Corporation and having a loss tangent of about 0.0002, is a suitable material for layer 140. A layer of PTFE having a thickness in the range of about 0.0025 to 0.0075 inches (about 0.0635 to 0.1905 mm) allows rapid cleaning of electrodes 120. Moreover, if coated with a non-conductive, non-stick material, the corrosion of aluminum or copper electrodes may be reduced. Further, if properly coated, aluminum electrodes may be used safely because direct contact with the product is prevented. Thus, the danger of contaminating products heated in tray 101 with aluminum or aluminum oxides is greatly reduced.

FIG. 6*b* depicts a cross-sectional view along line VI—VI in FIG. 5 of side wall 114 of tray 101 on which electrode 120 is mounted. Second portion 124 is curved to form a recess 126, so that tray lip 116 may fit snugly within recess 126. Areas of first portion 122 which may contact the product during heating or which are immersed in the heating fluid are coated with layer 140 of the non-electrically conductive, non-stick material. Although layer 140 may be extended onto second portion 124 to protect that portion from exposure to the heating fluid, such as boiling water that may splash from cavity 130 onto second portion 124, at least exposed area 125 is not covered by layer 140 to allow electrode 120 to electrically couple with a contact 150 extending into a heating cavity 170 of the dielectric oven. An electromagnetic power source 180, such as a power tube, is connected to contact 150.

The dimensions of trays 1 and 101 and electrodes 20 and 120 may be modified to accommodate various products to be heated or different oven sizes. Although a detailed description of the present invention is provided above, it is to be understood that the scope of the invention is not limited thereby, but is determined by the claims which follow.

I claim:

1. A dielectric oven comprising:

a housing having at least one housing side wall and defining a heating cavity;

at least a pair of contacts projecting into said heating cavity through said at least one housing side wall; and an electromagnetic energy source coupled and supplying current to said pair of contacts;

a removable tray for holding a product for heating in a dielectric oven, said tray comprising at least one wall defining an interior, wherein said at least one wall is made from a non-electrically conductive material and includes at least a first and a second electrode, each of said electrodes comprising a first portion and a second portion, such that said first portions bracket said product, are substantially parallel to each other, and are encased within said at least one wall and, such that each of said second portions has an exposed area which when said removable tray is placed in said oven is coupled with at least one of said pair of contacts to produce an electromagnetic field between said electrodes.

2. The dielectric oven of claim 1, wherein said electrodes are made from a non-magnetic, electrically conductive material.

3. The dielectric oven of claim 1, wherein said non-electrically conductive material is a thermoplastic resin selected from the group consisting of polysulphone, polyester, and polycarbonate resins.

4. The dielectric oven of claim 1, wherein said non-electrically conductive material has a low dielectric loss tangent and a melting point of at least about 225° F. (107° C.).

5. The dielectric oven of claim 1, wherein said electrodes are made from a material selected from the group consisting of copper, aluminum, and stainless steel.

6. A dielectric oven comprising:

an oven housing having at least one housing side wall and defining a heating cavity;

at least a pair of contacts projecting into said heating cavity through said at least one housing side wall; and an electromagnetic energy source coupled and supplying current to said pair of contacts;

a removable tray for holding a product for heating in a dielectric oven, said tray comprising at least one wall defining an interior, wherein said at least one wall is made from a non-electrically conductive material, and at least a first and a second electrode mounted on said tray prior to placing said tray in said oven, wherein each of said electrodes includes a first portion and a second portion, such that when said at least first and second electrodes are mounted on said tray, said first portions extend into said tray, bracket said product, and are substantially parallel to each other, and such that each of said second portions conform to an upper peripheral edge of said tray and have an exposed area which when said removable tray is placed in said oven is coupled with at least one of said pair of contacts to produce an electromagnetic field between said electrodes, wherein said electrodes are coated with a layer of non-electrically conductive material for preventing said product from contacting said electrodes.

7. The dielectric oven of claim 6, wherein said non-electrically conductive material has a low dielectric loss tangent and a melting point of at least about 225° F. (107° C.).

8. The dielectric oven of claim 9, wherein said non-electrically conductive material is a thermoplastic resin selected from the group consisting of polysulphone, polyester, and polycarbonate resins.

9. The dielectric oven of claim 6, wherein said electrodes are removably mounted on said tray.

10. The dielectric oven of claim 6, wherein said electrodes are made from a non-magnetic, electrically conductive material.

11. The dielectric oven of claim 7, wherein said electrodes are coated with a layer of polytetrafluoroethylene having a thickness in a range of about 0.0025 to 0.0075 inches (about 0.0635 to 0.1905 mm).

12. The dielectric oven of claim 11 wherein said electrodes are made from aluminum.

* * * * *